US005902415A

United States Patent [19]

Dunn et al.

[11] Patent Number: 5,902,415

[45] Date of Patent: May 11, 1999

[54] AQUEOUS SODIUM SALT METAL CLEANER AND METHOD OF USING SAME

[75] Inventors: Steven Dunn, Flemington; Gale A. Byrnes, Califon, both of N.J.

[73] Assignee: Church & Dwight Co., Inc., Princeton, N.J.

[21] Appl. No.: 09/015,535

[22] Filed: Jan. 29, 1998

Related U.S. Application Data

[62] Division of application No. 08/626,543, Apr. 2, 1996, Pat. No. 5,747,439.

[51] Int. Cl.[6] ..... B08B 3/08; C11D 3/08; C11D 3/10; C11D 3/28; C23G 1/14

[52] U.S. Cl. ..... 134/42; 134/2; 134/40; 510/255; 510/258; 510/265; 510/266; 510/365; 510/420; 510/421; 510/422; 510/423; 510/433; 510/435; 510/500; 510/509; 510/511

[58] Field of Search ..... 510/175, 176, 510/255, 258, 265, 266, 420, 421, 422, 423, 433, 435, 509, 511, 500, 365; 134/2, 40, 42

[56] References Cited

U.S. PATENT DOCUMENTS

| | | | |
|---|---|---|---|
| Re. 35,017 | 8/1995 | Winston et al. | 134/40 |
| Re. 35,045 | 10/1995 | Winston et al. | 134/40 |
| Re. 35,115 | 12/1995 | Winston et al. | 134/42 |
| 2,741,599 | 4/1956 | McDonald et al. | 252/138 |
| 3,419,502 | 12/1968 | Newman | 252/180 |
| 3,637,511 | 1/1972 | Yang | 252/527 |
| 3,959,166 | 5/1976 | Oberhofer et al. | 252/146 |
| 3,962,109 | 6/1976 | Oberhofer et al. | 252/146 |
| 4,098,720 | 7/1978 | Hwa | 252/389 R |
| 4,113,498 | 9/1978 | Rones et al. | 106/14.13 |
| 4,242,214 | 12/1980 | Lambert, Jr. | 252/75 |
| 4,349,448 | 9/1982 | Steele | 252/135 |
| 4,382,008 | 5/1983 | Boreland et al. | 252/75 |
| 4,389,371 | 6/1983 | Wilson et al. | 422/15 |
| 4,426,309 | 1/1984 | Abel et al. | 252/75 |
| 4,450,102 | 5/1984 | Lindstrom et al. | 252/542 |
| 4,457,322 | 7/1984 | Rubin et al. | 134/2 |
| 4,540,442 | 9/1985 | Smith et al. | 134/2 |
| 4,575,569 | 3/1986 | Edwards | 568/45 |
| 4,620,936 | 11/1986 | Kielman et al. | 252/99 |
| 4,756,846 | 7/1988 | Matsuura et al. | 252/156 |
| 4,759,864 | 7/1988 | Van Neste et al. | 252/75 |
| 4,931,205 | 6/1990 | Edwards et al. | 252/174.21 |
| 5,093,031 | 3/1992 | Login et al. | 252/357 |
| 5,096,609 | 3/1992 | Dany et al. | 252/135 |
| 5,110,494 | 5/1992 | Beck | 252/156 |
| 5,230,824 | 7/1993 | Carlson, Sr. et al. | 252/174.21 |
| 5,234,505 | 8/1993 | Winston et al. | 134/40 |
| 5,234,506 | 8/1993 | Winston et al. | 134/40 |
| 5,261,967 | 11/1993 | Winston et al. | 134/42 |
| 5,264,046 | 11/1993 | Winston et al. | 134/42 |
| 5,264,047 | 11/1993 | Winston et al. | 134/42 |
| 5,312,562 | 5/1994 | Vinci et al. | 510/175 |
| 5,393,448 | 2/1995 | Winston et al. | 252/109 |
| 5,397,495 | 3/1995 | Winston et al. | 252/109 |
| 5,431,847 | 7/1995 | Winston et al. | 252/174.24 |
| 5,433,885 | 7/1995 | Winston et al. | 252/174.24 |
| 5,464,553 | 11/1995 | Winston et al. | 252/108 |
| 5,549,761 | 8/1996 | Winston et al. | 134/40 |
| 5,558,109 | 9/1996 | Cala et al. | 134/42 |
| 5,593,504 | 1/1997 | Cala et al. | 134/1 |
| 5,650,385 | 7/1997 | Dunn et al. | 510/245 |
| 5,688,753 | 11/1997 | Cala et al. | 510/175 |
| 5,736,495 | 4/1998 | Bolkan et al. | 510/202 |
| 5,755,893 | 5/1998 | Cala et al. | 134/2 |
| 5,821,208 | 10/1998 | Cala et al. | 510/175 |
| 5,834,411 | 11/1998 | Bolkan et al. | 510/245 |

*Primary Examiner*—Ardith Hertzog
*Attorney, Agent, or Firm*—Irving Fishman

[57] ABSTRACT

An alkali metal cleaning composition for cleaning metal and for inhibiting corrosion of metal. The composition is composed of an alkali carbonate salt, a surfactant, and a corrosion inhibitor. A preferred corrosion inhibitor is an alkali metal silicate. Additional metal corrosion inhibitors such as a combination of a triazole compound and an alkali metal borate also can be employed. Such alkali carbonate compositions are readily water soluble and remain in solution over prolonged storage periods.

14 Claims, No Drawings

AQUEOUS SODIUM SALT METAL CLEANER AND METHOD OF USING SAME

The present application is a divisional of U.S. Ser. No. 08/626,543 filed Apr. 2, 1996, now U.S. Pat. No. 5,747,439.

BACKGROUND OF THE INVENTION

The present invention is directed to aqueous alkali metal cleaning compositions. In particular, the present invention is directed to aqueous alkali metal cleaning compositions containing water soluble salt builders and alkali metal silicate anticorrosion agents which are readily water soluble at pH levels below 11.0. The compositions of the present invention are useful in so-called parts washers which are particularly adapted for industrial cleaning, as well as for domestic use.

Parts washers of various kinds are known to those skilled in the art as having great utility for mechanics and others working in a variety of occupations, particularly those working in industrial plants, maintenance and repair services, and the like. Parts washers referred to herein include soak tanks, so-called hot tanks, immersion type parts cleaners with or without air agitation, spray washers (continuous or batch) and ultrasonic baths. Generally, parts washers are used to remove all types of contaminants adhered to metal surfaces including greases, cutting fluids, drawing fluids, machine oils, antirust oils such as cosmoline, carbonaceous oils, sebaceous oils, particulate matter, waxes, paraffins, used motor oil, fuels, etc.

Until recently, metal surfaces were cleaned of most oily and greasy contamination by use of solvents. Existing solvents, with or without special additives, are adequate to achieve good cleaning of most dirty, greasy, metal parts. A great number of solvents have been employed to produce metallic surfaces free from contamination. These wash solvents generally include various halogenated hydrocarbons and non-halogenated hydrocarbons, of significant quantity industry wide for cleaning and degreasing of metal surfaces, and the degree of success with each of these wash solvents generally is dependent upon the degree of cleanliness required of the resultant surface.

Recently, however, various hydrocarbon and halogenated hydrocarbon metal cleaning solvents previously employed have come under scrutiny in view of the materials employed, and in particular, the environmental impact from the usage of the various materials. This is particularly true in the case of parts cleaning which is done in closed environments such as garages and the like or for even home usage in view of the close human contact. Even addition of devices to parts washers which can reduce spillage, fire and excessive volatilization of cleaning solvents are not sufficient to alleviate present environmental concerns.

Although halogenated hydrocarbon solvents such as chlorofluorocarbons (CFCs) and trichloromethane, methylene chloride and trichloromethane (methyl chloroform) are used widely in industry for metal cleaning, their safety, environmental and cost factors coupled with waste disposal problems are negative aspects in their usage. A world-wide and U.S. ban on most halogenated hydrocarbon solvents is soon in the offing by virtue of the Montreal Protocol, Clean Air Act and Executive and Departmental directives.

Non-halogenated hydrocarbon solvents such as toluene and Stoddard solvent and like organic compounds such as ketones and alcohols on the other hand are flammable, have high volatility and dubious ability to be recycled for continuous use. Such properties plus unfavorable safety, environmental and cost factors, put this group of solvents in a category which is unattractive for practical consideration. Most useful organic solvents are classified as volatile organic compounds (VOCs) which pollute the atmosphere, promote formation of toxic ozone at ground level, and add to the inventory of greenhouse gases.

In order to eliminate the various negative aspects of known chemical washing and degreasing systems, it has, therefore, been suggested that an aqueous detergent system be used to overcome some of the inherent negative environmental and health aspects of such solvent cleaning systems. Unfortunately, aqueous cleaning systems are not without their own problems as related to use thereof in metal cleaning systems including use in parts washers as described above. For example, certain aqueous cleaners are exceedingly alkaline having pHs of 13 and above such as sodium hydroxide or include organic solvents such as alkanolamine, ethers, alcohols, glycols, ketones and the like. Besides being highly corrosive, exceedingly high alkaline aqueous solutions are highly toxic and can be dangerous to handle requiring extreme safety measures to avoid contact with skin. Organic solvent-containing aqueous cleaners present problems regarding toxicity, volatility or the environment as expressed previously. On the other hand, it is most difficult to obtain an aqueous detersive solution at moderate pH which is effective in removing greases and oils which contaminate metal and which would not be corrosive to metal.

One particular disadvantage of using aqueous systems to clean metal surfaces is a potential for corroding or discoloring metal surfaces. While aqueous cleaning solutions having a high pH such as formed from sodium hydroxide are often more corrosive than aqueous solutions having a relatively low pH, such as formed by moderately alkaline detergents, corrosion and discoloration still are problematic with more moderate solutions. Various corrosion inhibitors are known and have been used to prevent corrosion of surfaces which come into contact with aqueous alkaline solutions. Probably, the most effective and least costly of the known corrosion inhibitors are the silicates, such as alkali metal silicates. Unfortunately, alkali metal silicates begin to precipitate from aqueous solution at pHs below 11. This is true especially in aqueous concentrates. Such insolubility of alkali metal silicates greatly reduces effectiveness of such silicates to prevent corrosion of metal surfaces when used in aqueous cleaning solutions having a moderate pH. To prevent precipitation of silicate from aqueous concentrates below a pH of 11.0, acrylic acid polymers having a high molecular weight, i.e., 100,000 or greater, have been added to concentrates. A disadvantage to employing such polymers is their high viscosity which often leaves a hard residue along the sides of cleaning tanks. Removal of such residue can be both time consuming and difficult.

Another problem associated with aqueous cleaning compositions is solubility of builders in water. Alkali metal carbonates are especially desirable builders because such compounds are effective in removing grease and other contaminants from metals and are environmentally benign. However, alkali metal carbonates can be very difficult to solubilize in aqueous compositions, and to maintain soluble in aqueous compositions for periods of prolonged storage, thus compromising use of such builders in the cleaning industry.

Accordingly, to be as effective and be able to replace halogenated and hydrocarbon solvents now widely used, aqueous metal cleaning compositions will have to be formulated to solve the problems associated therewith including solubility of builders and anticorrosion agents, efficacy of detersive action at moderate pH levels, and corrosiveness inherent in aqueous based systems, in particular, on metal substrates.

A primary objective of the present invention is to provide an aqueous metal cleaning composition where silicate salts are readily water soluble and remain stable in solution at moderate pH ranges.

Another objective of the present invention is to provide an aqueous metal cleaning composition where carbonate salts are readily water soluble and remain in aqueous solution over prolonged storage periods.

Still another objective of the present invention is to provide an aqueous metal cleaning composition which can be used effectively in a variety of parts washing equipment to efficiently remove grease, oil and other contaminants from metal parts and which is safe to use and not a hazard to the environment in use or upon disposal, and is not irritating to human skin.

A further objective of the present invention is to provide an aqueous metal cleaning composition which contains an effective water soluble corrosion inhibitor.

SUMMARY OF THE INVENTION

The above-mentioned objectives and other objectives are obtained in accordance with the present invention by providing alkali metal cleaning compositions comprising a sodium carbonate salt builder and a sodium silicate anticorrosion agent which are readily soluble in aqueous compositions at a low pH. Surprisingly, sodium silicate has been found to be readily soluble in aqueous cleaning compositions of the present invention, and does not precipitate out of solution at a pH of less than 11.0. Advantageously, such silicate solubility excludes the need for high molecular weight acrylic acid polymers in cleaning compositions of the present invention, thus eliminating the scaling problem.

Unlike cleaning preparations containing halogenated or hydrocarbon solvents, aqueous sodium carbonate cleaning compositions of the present invention are environmentally safe in use and have only low amounts of organics which do not readily volatilize and which are safe on disposal thereof. Additionally, aqueous sodium carbonate compositions of the present invention have moderate pH levels, thus reducing any potential for damage to the environment or injury to workers employing such cleaning compositions, but have a sufficiently high pH to effectively clean dirt, grease, oil and the like from metal parts.

Preferably, detersive ability of aqueous sodium carbonate cleaning compositions are enhanced by addition of a surfactant. Particularly useful surfactants which can be used in cleaning compositions of the present invention are ones which are low foaming and readily permit contaminants to be skimmed from wash baths for disposal. Consequently, cleaning ability of such aqueous cleaners can be maintained for prolonged reuse.

DETAILED DESCRIPTION OF THE INVENTION

Alkali metal cleaning compositions of the present invention are useful for removing any type of contaminant from a metal surface including greases, cutting fluids, drawing fluids, machine oils, antirust oils such as cosmoline, carbonaceous oils, sebaceous oils, particulate matter, waxes, paraffins, used motor oil, fuels, etc. Any metal surface can be cleaned including iron-based metals such as iron, iron alloys, e.g., steel, tin, aluminum, copper, tungsten, titanium, molybdenum, etc., for example. The structure of the metal surface to be cleaned can vary widely and is unlimited. Thus, the metal surface can be as a metal part of complex configuration, sheeting, coils, rolls, bars, rods, plates, disks, etc. Such metal components can be derived from any source including for home use, for industrial use such as from the aerospace industry, automotive industry, electronics industry, etc., wherein metal surfaces have to be cleaned.

Treatment of aluminum surfaces with the compositions of this invention has been found particularly effective.

Aqueous alkali metal cleaning compositions of the present invention have a pH from about 8.0 to below 11.0 to render such compositions substantially less harmful to use and handle than highly alkaline aqueous cleaners such as those formed from sodium hydroxide or aqueous alkanolamine solutions. Aqueous alkali concentrates and solutions of the present invention preferably have a pH of from about 10.0 to less than 11.0 to effectively clean metal substrates of dirt, grease, oil and other contaminants without causing tarnishing or discoloration of a metal substrate and yet allow concentrates and solutions to be used, handled and disposed of without burning or irritating human skin. Preferably such compositions and resultant aqueous cleaning concentrates and solutions formed therefrom are free of organic solvents including hydrocarbon, halohydrocarbon and oxygenated hydrocarbon solvents.

Aqueous alkali metal cleaning compositions of the present invention comprise a water soluble alkali sodium carbonate salt and a water soluble sodium corrosion inhibitor. The term "carbonate" as used herein means a salt which contains either a $CO_3^{2-}$ or a $HCO_3^-$ radical.

Carbonate salts of alkali metal cleaning compositions of the present invention can be provided by one or more sodium carbonate salt or sodium bicarbonate suitable for cleaning oil and grease from a metal substrate and capable of providing a desired pH. Such carbonates are economical, safe and environmentally friendly. Sodium carbonate salts include, but are not limited to, sodium carbonate per se, sodium carbonate decahydrate, sodium carbonate heptahydrate, sodium carbonate monohydrate, sodium sesquicarbonate and double salts and mixtures thereof. Mixtures of the above mentioned sodium carbonate salts and sodium bicarbonate also are especially useful.

Other suitable salts which optionally can be used include alkaline metal ortho or complex phosphates. Examples of alkaline metal orthophosphates include trisodium or tripotassium orthophosphate. Complex phosphates are effective because of their ability to chelate water hardness and heavy metal ions. Complex phosphates include, for example, sodium or potassium pyrophosphate, tripolyphosphate and hexametaphosphates with the sodium salt preferred. It is preferred to limit the amount of phosphates (phosphorous) to less than 3 wt. % relative to the total weight of the dry composition inasmuch as phosphates are ecologically undesirable being a major cause of eutrophication of surface waters. Additional suitable alkaline salts useful in the metal cleaning compositions of the present invention include alkaline metal acetates, citrates, tartrates, succinates, phosphonates, edates, dilute solutions of sodium or potassium hydroxide, etc. with sodium salts preferred. When potassium salts are employed, it is preferable to limit the amount of potassium ion to about a 1:1 mole ratio with sodium ion. However, addition of any potassium to sodium salt compositions of the present invention causes sodium silicate to precipitate out of solution, especially over prolonged storage periods.

A preferred corrosion inhibitor added to sodium carbonate metal cleaning compositions of the present invention is sodium silicate. In accordance with a preferred embodiment of the present invention, it is desirable to employ one or more sodium silicates wherein the weight ratio of $SiO_2$:$Na_2O$ is in a range of from about 1.4:1 to about 2.9:1, preferably from about 2.0:1 to about 2.8:1. Such sodium silicates have good metal anticorrosion effectiveness, and high water solubility in aqueous compositions of the present invention.

Other suitable anticorrosion agents include, but are not limited to, a combination of a water soluble triazole compound and an alkali metal borate. Triazoles which can be employed in the composition of the present invention are any water-soluble 1,2,3-triazole such as 1,2,3-triazole itself having the formula

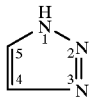

or an N-alkyl substituted 1,2,3-triazole, or a substituted water soluble 1,2,3-triazole where the substitution takes place in the 4- and/or 5-position of the triazole ring. A preferred 1,2,3-triazole is benzotriazole (sometimes known as 1,2,3-benzotriazole) having the structural formula:

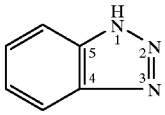

Other suitable water soluble derivatives include 4-phenyl-1,2,3-triazole; 1,2-naphthotriazole; 4-nitrobenzotriazole; 1,2,3-tolytriazole; 4-methyl-1,2,3-triazole; 4-ethyl-1,2,3-triazole; 5-methyl-1,2,3-triazole; 5-ethyl-1,2,3-triazole; 5-propyl-1,2,3-triazole; 5-butyl-1,2,3-triazole; and the like.

Alkali metal borate components of the present invention can be any borax, alkali metal metaborate or alkali metal tetraborate compound, or mixtures thereof. Hydrated alkali metal tetraborate compounds are particularly preferred, with sodium tetraborate decahydrate and sodium tetraborate pentahydrate most preferred. The combination of a triazole compound and an alkali metal borate has anticorrosion activity on all metals, but is especially effective in inhibiting corrosion of copper containing metals.

It has been found advantageous to add a carboxylated polymer to aqueous concentrates and solutions of the present invention just prior to diluting with tap-water before cleaning on an industrial scale to prevent scaling. Deionized water typically is not used under industrial cleaning conditions, but rather tap-water is employed. Tap-water can contain ions such as calcium and heavy metals which can form complexes with carbonate and bicarbonate salts to form insoluble salts resulting in scaling. Carboxylated polymers form complexes with calcium and heavy metal ions, thus preventing scaling. Useful carboxylated polymers can be categorized generically as water-soluble carboxylic acid polymers such as polyacrylic and polymethacrylic acids or a vinyl addition polymer. of vinyl addition polymers contemplated, maleic anhydride copolymers as with vinyl acetate, styrene, ethylene, isobutylene, acrylic acid and vinyl ethers are preferred.

All of the above-described polymers are water-soluble or at least colloidally dispersable in water. The molecular weight of these polymers may vary over a broad range although it is preferred to use polymers having average molecular weights ranging between about 1,000 to less than 100,000. Carboxylated polymers having high molecular weights of about 100,000 or greater preferably are not employed because such polymers cause scaling in cleaning tanks. In a preferred embodiment of the present invention such polymers have a molecular weight of about 10,000 or less, and most preferably between about 2500 to about 5000.

Water-soluble polymers of the type described above are often in the form of copolymers which are contemplated as being useful in the practice of this invention provided they contain at least 10% by weight of

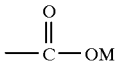

groups where M is hydrogen, alkali metal, ammonium or other water-solubilizing radicals. Such polymers or copolymers can be prepared by either addition or hydrolytic techniques. Thus, maleic anhydride copolymers are prepared by the addition polymerization of maleic anhydride and another comonomer such as styrene. Preferred low molecular weight acrylic acid polymers can be prepared by addition polymerization of acrylic acid or its salts either with itself or other vinyl comonomers. Alternatively, such polymers can be prepared by the alkaline hydrolysis of low molecular weight acrylonitrile homopolymers or copolymers. For such a preparative technique see Newman U.S. Pat. No. 3,419,502 which is hereby incorporated herein in its entirety by reference. An example of a low molecular weight acrylic acid polymer is Alcosperse 2310 having a M.W. of from about 2500 to about 4500, a product of Alco Chemical Corp., Chattanooga, Tenn.

Useful maleic anhydride polymers are selected from the group consisting of homopolymers of maleic anhydride, and copolymers of maleic anhydride with vinyl acetate, styrene, ethylene, isobutylene, acrylic acid and vinyl ethers. Such polymers can be easily prepared according to standard methods of polymerization.

To improve cleaning efficacy of cleaning compositions of the present invention, it is preferred to add one or more surfactants. Nonionic surfactants are preferred as such surfactants are best able to remove dirt, grease and oil from metal substrates.

Among the most useful surfactants in view of the ability thereof to remove grease and oil are the nonionic alkoxylated thiol surfactants. Nonionic alkoxylated (ethoxylated) thiol surfactants of the present invention are known and are described for example in U.S. Pat. Nos. 4,575,569 and 4,931,205, the contents of both of which are hereby incorporated herein in their entirety by reference. In particular, the ethoxylated thiol is prepared by addition of ethylene oxide to an alkyl thiol of the formula R-SH wherein R is alkyl in the presence of either an acid or base catalyst. A thiol reactant that is suitable for producing the surfactant used in the practice of the present invention comprises, in the broad sense, one or more of the alkane thiols as have heretofore been recognized as suitable for alkoxylation by reaction with alkylene oxides in the presence of basic catalysts. Alkane thiols having from 6 to 30 carbons are particularly preferred reactants for preparation of thiol alkoxylates for use as surface active agents, while alkane thiols having from 7 to 20 carbons are considered more preferred and alkane thiols having from 8 to 18 carbons are most preferred.

Broadly, the surfactant can be formed from reaction of the above alkyl thiol and one or more of the several alkylene oxides known for use in alkoxylation reactions with thiols and other compounds having active hydrogen atoms. Particularly preferred are vicinal alkylene oxides having from 2 to 4 carbon atoms, including ethylene oxide, 1,2-propylene oxide, and 1,2- and 2,3-butylene oxides. Mixtures of alkylene oxides are suitable in which case the product will be mixed thiol alkoxylate. Thiol alkoxylates prepared from ethylene or propylene oxides are recognized to have very advantageous surface active properties and for this reason there is a particular preference for a reactant consisting essentially of ethylene oxide which is considered most preferred for use in the invention.

The relative quantity of thiol and alkylene oxide reactants determine the average alkylene oxide number of the alkoxylate product. In alkoxylated thiol surfactants of the present invention, an adduct number in the range from about 3 to 20, particularly from about 3 to 15 is preferred. Accordingly, preference can be expressed in the practice of the present invention for a molar ratio of alkylene oxide reactant to thiol reactant which is in the range of from about 3 to 20, particularly from about 3 to 15. Especially preferred is an ethoxylated dodecyl mercaptan with about 6 ethylene oxide units. Such a surfactant is a commercial product known as ALCODET 260 marketed by Rhone-Poulenc.

Unfortunately, ethoxylated thiol surfactants have an unpleasant odor which is imparted to the aqueous solution in which it is placed. It has been found that the addition of a nitrogen-containing surfactant eliminates the odor of the sulfur-containing surfactant and does not adversely effect the efficacy of the ethoxylated thiol surfactant to remove grease, oil and the like from the metal surfaces. Among useful nitrogen-containing nonionic surfactants are the following:

A surfactant having a formula $R^1R^2R^3N\rightarrow 0$ (amine oxide detergent) wherein $R^1$ is an alkyl group containing from about 10 to about 28 carbon atoms, from zero to about two hydroxy groups and from zero to about five ether linkages, there being at least one moiety of $R^1$ which is an alkyl group containing from about 10 to about 18 carbon atoms and zero ether linkages, and each $R^2$ and $R^3$ are selected from the group consisting of alkyl radicals and hydroxyalkyl radicals containing from one to about three carbon atoms.

Specific examples of amine oxide surfactants include: Dimethyldodecylamine oxide, dimethyltetradecylamine oxide; ethylmethyltetradecylamine oxide, cetyldimethylamine oxide, dimethylstearylamine oxide, cetylethylpropylamine oxide, diethyldodecylamine oxide, diethyltetradecylamine oxide, dipropyldodecylamine oxide, bis-(2-hydroxyethyl)dodecylamine oxide, bis-(2-hydroxyethyl)-3-dodecoxy-1-hydroxypropyl amine oxide, (2-hydroxypropyl) methyltetradecylamine oxide, dimethyloleyamine oxide, dimethyl-(2-hydroxydodecyl)amine oxide, and the corresponding decyl, hexadecyl and octadecyl homologs of the above compounds.

Additional nitrogen-containing surfactants include ethoxylated primary alkyl amines where the alkyl group has 10–20 carbon atoms and the amine is ethoxylated with 2–20 ethylene oxide units. Further surfactants include ethoxylated long chain fatty acid amides where the fatty acid has 8–20 carbon atoms and the amide group is ethoxylated with 1–20 ethylene oxide units. Additionally, nonionic surfactants derived from the condensation of ethylene oxide with the product resulting from the reaction of propylene oxide and ethylene diamine are also useful. For example, compounds containing from about 40% to about 80% of polyoxyethylene by weight and having a molecular weight from about 5,000 to about 11,000 resulting from the reaction of ethylene oxide groups with a hydrophobic base constituted of the reaction product from ethylene diamine and excess propylene oxide wherein the base has a molecular weight on order of 2,500–3,000 are satisfactory.

One of the most useful nitrogen-containing surfactants are those derived from N-alkyl pyrrolidone. This surfactant is one which can be used alone to achieve excellent cleaning or used in combination with the ethoxylated thiol surfactant. Particularly preferred is N-(n-alkyl)-2-pyrrolidone wherein the alkyl group contains 6–15 carbon atoms. Such compounds are described in U.S. Pat. No. 5,093,031, assigned to ISP Investments, Inc., Wilmington, DE and which discloses surface active lactams and is herein incorporated by reference. The above N-alkyl pyrrolidone products having a molecular weight of from about 180 to about 450 are conveniently prepared by several known processes including the reaction between a lactone having the formula

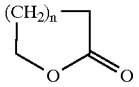

wherein n is an integer from 1 to 3, and an amine having the formula $R'\text{-}NH_2$ wherein R' is a linear alkyl group having 6 to 20 carbon atoms. The amine reactant having the formula $R'\text{-}NH_2$ includes alkylamines having from 6 to 20 carbon atoms; amines derived from natural products, such as coconut amines or tallow amines distilled cuts or hydrogenated derivatives of such fatty amines. Also, mixtures of amine reactants can be used in the process for preparing the pyrrolidone compounds.

Generally, the $C_6$ to $C_{14}$ alkyl pyrrolidones have been found to display primarily surfactant properties, whereas the $C_{16}$ to $C_{22}$ alkyl species are primarily complexing agents, although some degree of surfactant and complexing capability exists in all of the present species.

The relative amounts of the ethoxylated thiol surfactant and nitrogen-containing surfactant, if used in combination, are not overly critical as far as a contrite range is concerned in that the amount of the nitrogen surfactant will vary depending on the surfactant used. The amount of nitrogen-containing surfactant used should be that which can reduce, if not eliminate, odor from ethoxylated thiol surfactants. It is believed that the relative amounts by weight of the ethioxylated thiol surfactant to the nitrogen-containing surfactant should range from about 1.0:0.1 to 1.0:2.0, and preferably from about 1.0:0.2 to 1:1. It is not meant that these ratios are to be considered as strictly limiting the invention and as providing the only relative amounts of the respective surfactants which can be effectively used and it is intended that any useful ratio be considered part of the present invention. Any useful ratio is that ratio which is sufficient to remove dirt, grease, oil and other contaminants from a metal surface and which will yield an aqueous product which has greatly reduced malodor relative to an equivalent composition in which the ethoxylated thiol surfactant is present and the nitrogen-containing surfactant is not.

Other surfactants can be used in compositions of the present invention other than, or in addition to, the above described surfactants. Especially preferred are surfactants which do not readily emulsify contaminants removed from metal surfaces such that a distinct oil phase separates from an aqueous phase such that contaminants can then be skimmed easily or otherwise easily separated from the wash bath for disposal. Consequently, the cleaning ability of the aqueous cleaner can be maintained for prolonged reuse. It is believed that most of the ethoxylated surfactants do not substantially emulsify the removed contaminants.

Suitable non-ionic surfactants include the polyoxyethylene-polyoxypropylene condensates, which are sold by BASF under the tradename "Pluronic", and modified oxyethylated straight chain alcohols also sold by BASF under the tradename "Plurafac" such as Plurafac LF 120; polyoxyethylene condensates of aliphatic alcohols/ethylene oxide condensates having from 1 to 30 moles of ethylene oxide per mole of coconut alcohol; ethoxylated long chain alcohols sold by Shell Chemical Co. under the tradename "Neodol", polyoxyethylene condensates of sorbitan fatty acids, alkanolamides, such as the monoalkoanolamides, dialkanolamides and the ethoxylated alkanolamides, for example coconut monoethanolamide, lauric isopropanolamide and lauric diethanolamide; and amine oxides for example dodecyldimethylamine oxide. Also effective are polycarboxylated ethylene oxide condensates of fatty alcohols manufactured by Olin under the tradename of "Polytergent CS-1", and alkoxylated alcohols which are sold under the tradename of "polytergent SL-Series" also by Olin Corporation.

Polyethylene oxide/polypropylene oxide condensates of alkyl phenols are believed to be low emulsifying but are not effectively biodegradable to be particularly useful surfactants and are preferably avoided.

Examples of suitable anionic surfactants are water-soluble salts of the higher alkyl sulfates, such as sodium lauryl sulfate or other suitable alkyl sulfates having 8 to 18 carbon atoms in the alkyl group, water-soluble salts of higher fatty acid monoglyceride monosulfates, such as the sodium salt of the monosulfated monoglyceride of hydrogenated coconut oil fatty acids, alkyl aryl sulfonates such as sodium dodecyl benzene sulfonate, higher alkyl sulfoacetates, higher fatty acid esters of 1,2-dihydroxy propane sulfonate, and the substantially saturated higher aliphatic acyl amides of lower aliphatic amino carboxylic acid compounds, such as those having 12 to 16 carbons in the fatty acid, alkyl or acyl radicals, and the like. Examples of the last mentioned amides are N-lauroyl sarcosinate, and the sodium, potassium, and ethanolamine salts of N-lauroyl, N-myristoyl, or N-palmitoyl sarcosinate sold by W. R. Grace under the tradename "Hamposyl". It is most preferred that aqueous cleaning solutions of this invention be low foaming during use. Accordingly, the sulfate and sulfonate surfactants may not always be acceptable if the cleaning process involves agitation of the cleaning solution.

Besides an alkalinity providing agent, corrosion inhibitor, a surfactant, and optional carboxylated polymer as described above, aqueous metal cleaning compositions of the present invention preferably include a hydrotrope.

Hydrotropes useful in the present invention include sodium, potassium, ammonium and alkanol ammonium salts of xylene, toluene, ethylbenzoate, isopropylbenzene, naphthalene, alkyl naphthalene sulfonates, phosphate esters of alkoxylated alkyl phenols, phosphate esters of alkoxylated alcohols and sodium, potassium and ammonium salts of the alkyl sarcosinates with sodium salts preferred. Hydrotropes are useful in maintaining any organic materials including surfactants readily dispersed in aqueous cleaning solutions and, in particular, in an aqueous concentrate which is an especially preferred form of packaging compositions of the present invention and allow a user of the compositions to accurately provide desired amounts of cleaning composition into an aqueous wash solution. A particularly preferred hydrotrope is one that does not foam. Among the most useful of such hydrotropes are those which comprise alkali metal salts of intermediate chain length linear alkyl mon6carboxylic fatty acids, i.e., $C_7$–$C_{13}$. Particularly preferred are alkali metal octanoates and nonanoates with sodium octanoates and sodium nonanoates especially preferred.

Alkali metal cleaning compositions of the present invention, based on a composition's dry weight, comprise from about 10 to about 70 weight percent, preferably, from about 15 to about 30 weight percent, most preferably, from about 20 to about 25 weight percent of a sodium carbonate salt; about 0.1 to about 25 weight % of a corrosion inhibitor; from about 5 to about 30 weight % of a surfactant; 0 to about 15 weight percent of a polycarboxylate; and 0 to about 60 weight percent, preferably, about 10 to about 40 weight percent of a hydrotrope.

If a combination of a sodium carbonate salt and sodium bicarbonate is utilized, sodium bicarbonate, preferably, comprises from about 5 to about 60 weight percent and a sodium carbonate salt, preferably, from about 5 to about 40 weight percent based on the dry composition.

Individually, sodium silicate is added to dry compositions of the present invention in amounts of from about 1.0 wt. % to about 25 wt. %, preferably from about 5 wt. % to about 10 wt. %.

Triazoles and alkali metal borates each are added to compositions of the present invention in amounts of from about 0.5 to about 1.5 wt. % of the dry weight of a composition. The weight ratio of triazole compound to alkali metal borate can range from about 2:1 to about 1:2, preferably about 1:1. Alkali metal borate can be added per se, or as boric acid plus an alkali hydroxide, such as sodium or potassium Hydroxide, with sodium hydroxide being preferred, in a concentration of about 3 to about 7 wt. %.

Most preferably, metal cleaning compositions of the present invention are formulated and added to a wash bath as an aqueous concentrate in which dry components of the composition comprise from about 5 to about 45 weight percent of the concentrate, preferably, from about 10 to about 30 weight percent. In concentrate form, carbonate salt comprises from about 0.5 to about 30 wt. % of the aqueous concentrate; a surfactant comprises from about 0.5 to about 20 wt. % of the aqueous concentrate; a corrosion inhibitor comprises from about 0.2 to about 15 wt. % of the aqueous concentrate; a carboxylate from about 0 to about 5 wt. % and from 0 to about 20 wt. % of a hydrotrope.

Dry composition is used in an aqueous wash solution in amounts of from about 0.1 to about 10 weight percent, preferably from about 0.2 to about 5 weight percent.

Metal cleaning compositions of the present invention are useful in removing a variety of contaminants from metal substrates as previously described. A useful method of cleaning such metal parts is in a parts washer. In parts washers metal parts are contacted with the aqueous compositions either by immersion or some type of impingement in which the aqueous cleaning composition is circulated or continuously agitated against a metal part or is sprayed thereon. Alternatively, agitation can be provided as ultrasonic waves. The cleaning composition then is filtered and recycled for reuse in the parts washer.

For best use, aqueous cleaning compositions of the present invention preferably are at an elevated temperature typically ranging from about 90°–180° F. Contact time of aqueous cleaning compositions with metal substrates can vary depending upon the degree of contamination but broadly can range from about 1 minute to about 30 minutes with about 3 minutes to about 15 minutes being more typical.

SODIUM CARBONATE METAL CLEANER EXAMPLE AND CONTROL EXAMPLES 1 AND 2

The following example shows solubility of sodium silicate in aqueous sodium salt solutions of the present invention at a pH below 11.0 in contrast to cleaning solutions which are not predominantly sodium salt compositions within the scope of the present invention.

The composition of Table 1 was prepared by first heating one liter of water to about 80 degrees C and then dissolving surfactants, such as an N-alky pyrrolidone and a modified oxyethylated straight chain alcohol, in the water followed by adding and dissolving anticorrosion agents and then sodium carbonate salts into the water mixture. The solution was stirred at 60 rpm during addition of the components. Stirring was continued for about 20 minutes thereafter followed by allowing the solution to cool to room temperature. At room temperature, the pH of the solution was measured by a pH meter to be about 10.9. Two hours after cooling to room temperature there was no sign of precipitation of any solids from the solution.

In contrast to the solution in Table 1, the control solutions were predominantly potassium salt solutions with potassium silicate instead of sodium silicate as a corrosion inhibitor. Additionally, Control solution 1 contained a high molecular weight water-soluble, crosslinked acrylic acid polymer to keep potassium silicate in solution. Control solutions 1 and 2 disclosed in Table 2 were prepared by the same method as the composition in Table 1. After cooling to room temperature, the pH of each control solution was measured with a pH meter to be about 10.9. About two hours after cooling to room temperature, Control solution 2 appeared cloudy with a white precipitate, i.e., potassium silicate, collecting at the bottom of the beaker. No potassium silicate precipitate appeared in Control solution 1 after two hours of cooling since the high molecular weight water-soluble crosslinked acrylate, Carbopol, keeps potassium silicate in solution. However, a film of hard residue of high molecular weight acrylic polymer (Carbopol) developed along the sides of the beaker.

Advantageously, the aqueous sodium solution of the present invention (Table 1) was clear and retained sodium silicate in solution at a pH below 11.0 without the need for high molecular weight acrylic polymers. As is well known in the art, potassium salts, in general, are more water soluble than sodium salts. However, the sodium composition of Table 1 was more water soluble than the potassium composition of Control 2. Further, sodium carbonate cleaning compositions of the present invention did not leave an undesirable hard residue along sides of the beaker, thus eliminating the time consuming problem of scraping acrylic residue from cleaning apparatus. Additionally, the lower pH range, i.e., below 11.0, reduced the possibility of physical injury to the worker handling the cleaning solution, and the cleaning composition was sewered without posing a serious hazard to the environment.

TABLE 1

| Sodium Carbonate Metal Cleaner Example (% Weight) | |
|---|---|
| Water (deionized) | 75.30 |
| Sodium hydroxide | 0.90 |
| Sodium carbonate mono hydrate | 5.50 |
| Sodium silicate | 1.80 |
| Sodium borate pentahydrate | 0.25 |
| Cobratec TT-100[1] | 0.25 |
| Alcosperse 2310[2] | 2.50 |
| Monatrope 1250[3] | 7.50 |
| Plurafac LF 120[4] | 5.00 |

TABLE 1-continued

| Sodium Carbonate Metal Cleaner Example (% Weight) | |
|---|---|
| ISP LP-100[5] | 1.00 |
| pH | 10.9 |

[1]Tradename for 1,2,3-benzotriazole by B. F. Goodrich.
[2]Acrylic acid polymer, MW 2,500–4,500, Alco Chemical Corp., Chattanooga, TN.
[3]Intermediate chain length linear alkyl monocarboxylic fatty acid.
[4]Tradename for a modified oxyethylated straight chain alcohol by BASF.
[5]N-alkyl pyrrolidone surfactant by ISP.

TABLE 2

| | Controls (% Weight) | |
|---|---|---|
| | I | II |
| Water (deionized) | 70.09 | 73.80 |
| Pot. hydroxide | 0.90 | 0.90 |
| Pot. bicarbonate | 5.00 | 0.00 |
| Potassium carbonate | 1.96 | 7.00 |
| Potassium silicate | 1.80 | 1.80 |
| Pot. tetraborate pentahydrate | 0.25 | 0.25 |
| Cobratec TT-100 | 0.25 | 0.25 |
| Alco 2310 | 2.50 | 2.50 |
| Monotrope 1250 | 7.50 | 7.50 |
| Carbopol | 3.75 | 0.00 |
| ISP LP-100 | 1.00 | 1.00 |
| Plurafac LF 120 | 5.00 | 5.00 |
| pH | 10.9 | 10.9 |

What is claimed is:

1. A method for cleaning a metal surface comprising contacting the metal surface with an aqueous alkaline solution for a sufficient amount of time to remove contaminants therefrom, wherein the aqueous alkaline solution comprises from about 0.1 to about 10 wt. % of an alkali metal cleaning composition, wherein the composition comprises a carbonate salt comprising a sodium carbonate salt, or sodium bicarbonate salt; a surfactant; and sodium silicate salt, and the pH of the aqueous solution ranges from about 8.0 to less than 11.0, and wherein said carbonate salt comprises from about 15 to about 30 wt. % of the dry composition and said surfactant comprises from about 5 to about 30 wt. % of the dry composition, and wherein the composition has a phosphate content based on phosphorous of less than 3 wt. % relative to the total weight of the dry composition, said alkali metal cleaning composition being free of acrylic acid polymers having a molecular weight of 100,000 or greater.

2. The method of claim 1, wherein the sodium silicate salt has a $SiO_2$:$Na_2O$ weight ratio of from about 1.4:1 to about 2.9:1.

3. The method of claim 1, said composition further comprising a triazole compound and an alkali metal borate anticorrosion agent.

4. The method of claim 3, wherein the amount of triazole compound and alkali metal borate each range from about 0.5 to about 1.5 wt. % of the composition.

5. The method of claim 4, wherein the weight ratio of triazole compound to alkali metal borate is about 1:1.

6. The method of claim 3, wherein the triazole compound comprises 1,2,3-benzotriazole; 4-phenyl-1,2,3-triazole; 1,2-naphthotriazole; 4-nitrobenzotriazole; 1,2,3-tolytriazole; 4-methyl-1,2,3-triazole; 4-ethyl-1,2,3-triazole; 5-methyl-1,2,3-triazole; 5-ethyl-1,2,3-triazole; 5-propyl-1,2,3-triazole; or 5-butyl-1,2,3-triazole.

7. The method of claim 3, wherein the alkali metal borate comprises sodium tetraborate pentahydrate or sodium tetraborate decahydrate.

8. The method of claim 1, wherein the carbonate salt consists essentially of the sodium carbonate salt, the sodium bicarbonate salt and mixtures thereof.

9. The method of claim 8, wherein, the sodium carbonate salt comprises sodium carbonate, sodium carbonate decahydrate, sodium carbonate heptahydrate, sodium carbonate monohydrate, sodium sesquicarbonate or mixtures thereof.

10. The method of claim 1, wherein the surfactant is a nonionic surfactant.

11. The method of claim 1, wherein the surfactant is an ethoxylated alkyl-thiol having from 7 to 20 carbons and is ethoxylated with 3 to 15 ethylene oxide units.

12. The method of claim 1, wherein the surfactant comprises a nitrogen-containing surfactant.

13. The method of claim 12, wherein the nitrogen-containing surfactant is an N-alkyl pyrrolidone.

14. The method of claim 1, wherein the solution further comprises a hydrotrope.

* * * * *